US007168693B1

(12) United States Patent
Sjuts et al.

(10) Patent No.: US 7,168,693 B1
(45) Date of Patent: Jan. 30, 2007

(54) ADJUSTABLE ANGLE CLAMP

(76) Inventors: Eric Sjuts, P.O. Box 254, Humphrey, NE (US) 68642; Steve Classen, 4910 N. 57th St., Suite B., Lincoln, NE (US) 68507

( * ) Notice: Subject to any disclaimer, the term of this patent is extended or adjusted under 35 U.S.C. 154(b) by 133 days.

(21) Appl. No.: 10/912,596

(22) Filed: Aug. 5, 2004

(51) Int. Cl.
*B25B 1/20* (2006.01)

(52) U.S. Cl. ..... 269/37; 269/71

(58) Field of Classification Search ..... 269/37, 269/43, 41, 111–116, 124, 71, 45
See application file for complete search history.

(56) References Cited

U.S. PATENT DOCUMENTS

| | | | | |
|---|---|---|---|---|
| 979,305 | A * | 12/1910 | Hunt | 269/9 |
| 1,081,311 | A | 12/1913 | Joachimson | |
| 1,169,671 | A | 1/1916 | Nihlen | |
| 2,941,557 | A | 6/1960 | Baprawski | |
| 4,226,409 | A | 10/1980 | Hanna | |
| 4,881,726 | A | 11/1989 | Jolkovski | |
| 4,984,775 | A * | 1/1991 | Kahlke | 269/41 |
| 5,401,354 | A * | 3/1995 | Colucci | 156/580 |
| 5,494,553 | A | 2/1996 | Colucci | |
| 5,785,305 | A | 7/1998 | Stalker | |
| 5,992,836 | A * | 11/1999 | Howe | 269/41 |
| 6,427,993 | B1 * | 8/2002 | Prochac | 269/37 |
| 6,889,968 | B1 * | 5/2005 | Wong | 269/91 |

* cited by examiner

*Primary Examiner*—Lee D. Wilson
(74) *Attorney, Agent, or Firm*—Thomte, Mazour & Niebergall; Shane M. Niebergall

(57) ABSTRACT

The adjustable angle clamp of the present invention is provided with opposing arm members that are pivotably coupled to one another. Jaw members are independently advanced or withdrawn along the lengths of the arm members to provide clamping pressure at a joint formed between opposing objects disposed between the jaws. An angle adjustment screw is coupled to the arm members to incrementally adjust the angular relationship of the arm members with respect to one another and secure the clamp at selected angle settings.

18 Claims, 3 Drawing Sheets

ADJUSTABLE ANGLE CLAMP

BACKGROUND OF THE INVENTION

1. Field of the Invention

The present invention relates to clamping devices used to secure opposing objects to one another and more particularly to a clamping device capable of securing opposing objects to one another at nearly any desired angular relationship with respect to one another, while applying substantially even pressure at the joint formed between the objects.

2. Description of the Prior Art

Clamping devices are frequently used by woodworkers when joining opposing objects to one another with glue and/or fasteners. Numerous different clamp designs are known for securing objects in an edge-to-edge, coplanar fashion. However, these clamps and the method of using the same are typically only useful when the mating faces of the opposing objects are disposed at right angles. Cabinet making and other woodworking endeavors frequently require the joining of opposing objects at an angle with respect to one another. One common example can be found in the ubiquitous picture frame, where opposing pieces of wood are joined at ninety degree angles with respect to one another at mating faces that have each been cut at a forty-five degree angle. Clearly, the basic clamp design that provides linear clamping pressure will not work to secure the mitered pieces of wood to one another at the angled joint.

Several prior art designs exist for clamping opposing pieces of wood to one another at an angle. For example, U.S. Pat. No. 1,169,671 discloses a clamping device for securing objects at ninety degree angles with respect to one another. Specifically, the clamp provides a pair of jaw members set at a ninety degree relationship to one another. One jaw is disposed in a fixed position, while the opposing jaw may be manually actuated toward and away from the first jaw. While such a design is helpful, it has a number of shortcomings. First, the angular relationship of the jaws is set for securing objects at right angles to one another. Acute or obtuse angles are not obtainable using this design. Secondly, the angular disposition of the jaws provides unequal clamping pressure on the joint, which limits the amount of pressure that may be applied to the joint and may ultimately weaken the same. U.S. Pat. No. 5,785,305 functions in a similar manner, having a first clamping arm fixed in a static position and angle with respect to the horizontal. A second clamping arm is fixed in its angular relationship to the horizontal and is manually advanced and retracted with respect to the first clamping arm. This design also fails to provide a variable angle function. Moreover, despite the fact that the clamping pressure provided at the mating surfaces of the opposing objects is more even than that provided by predecessor clamps, it still fails to provide substantially uniform pressure along the mating surfaces.

U.S. Pat. No. 2,941,557 discloses an adjustable angle clamp that can secure opposing structures in a plurality of different angles with respect to one another. The clamp is designed to have a pair of opposing clamping surfaces that are pivotably coupled to one another and a pair of clamping arms that are disposed perpendicularly to the clamping surfaces to secure the objects thereto. While such a design provides an adjustable angle feature, it fails to provide a clamp that is capable of applying clamping pressure at the joint formed between the opposing objects. Moreover, the manner in which the opposing objects are secured within the clamp requires awkward, minute adjustments to the position of each of the opposing pieces of wood in order to properly align their mating surfaces at the set angle.

Accordingly, what is needed is a novel clamping device that is capable of securing opposing objects to one another at various angles with respect to one another while providing a substantially even claming force at the joint formed between the opposing objects.

SUMMARY OF THE INVENTION

The adjustable angle clamp of the present invention is provided with first and second arm members, having lengths that extend between first and second end portions. The first and second arm members are pivotably coupled to one another at their respective first end portions. This permits the movement of the first and second arm members with respect to one another through a wide range of different angles. Both the first and second arm members are provided with jaws that are selectively movable along the length of the arm members. In one preferred embodiment, the jaws are actuated using elongated rods that are disposed along the lengths of the first and second arm members. The rods may be threaded to engage mating threads disposed through the jaw members so that the jaws may be advanced and withdrawn in an incremental fashion along the arm members as the rods are rotated.

In one preferred embodiment, an angle adjustment screw is operatively coupled at its terminal adjacent the first end portion of the first arm member. An adjustment block is secured to the first end portion of the second arm member and is operatively coupled to the adjustment screw so that the adjustment screw may be incrementally advanced or withdrawn from the adjustment block, moving the first arm member through various angular relationships with the second arm member accordingly.

It is therefore a principal object of the present invention to provide a clamping device capable of securing opposing objects to one another in a plurality of various angles.

A further object of the present invention is to provide a clamping device that provides substantially even clamping pressure on a mitered joint between opposing objects.

Still another object of the present invention is to provide a clamping device that provides substantially uniform but variable clamping pressure on angular joints formed between opposing objects.

Yet another object of the present invention is to provide an adjustable angle clamp that is relatively simple in construction and use.

These and other objects of the present invention will be apparent to those skilled in the art.

DESCRIPTION OF THE PREFERRED EMBODIMENT

The angular clamping device 10 of the present invention is generally depicted in one of its preferred embodiments in FIGS. 1–5. While the clamping device 10 will be described herein as the same can be used to clamp opposing pieces of wood to one another, it will be understood by those of skill in the art that the clamping device 10 can be used to clamp opposing objects of nearly any shape or composition to one another for a variety of purposes.

Figure 1:
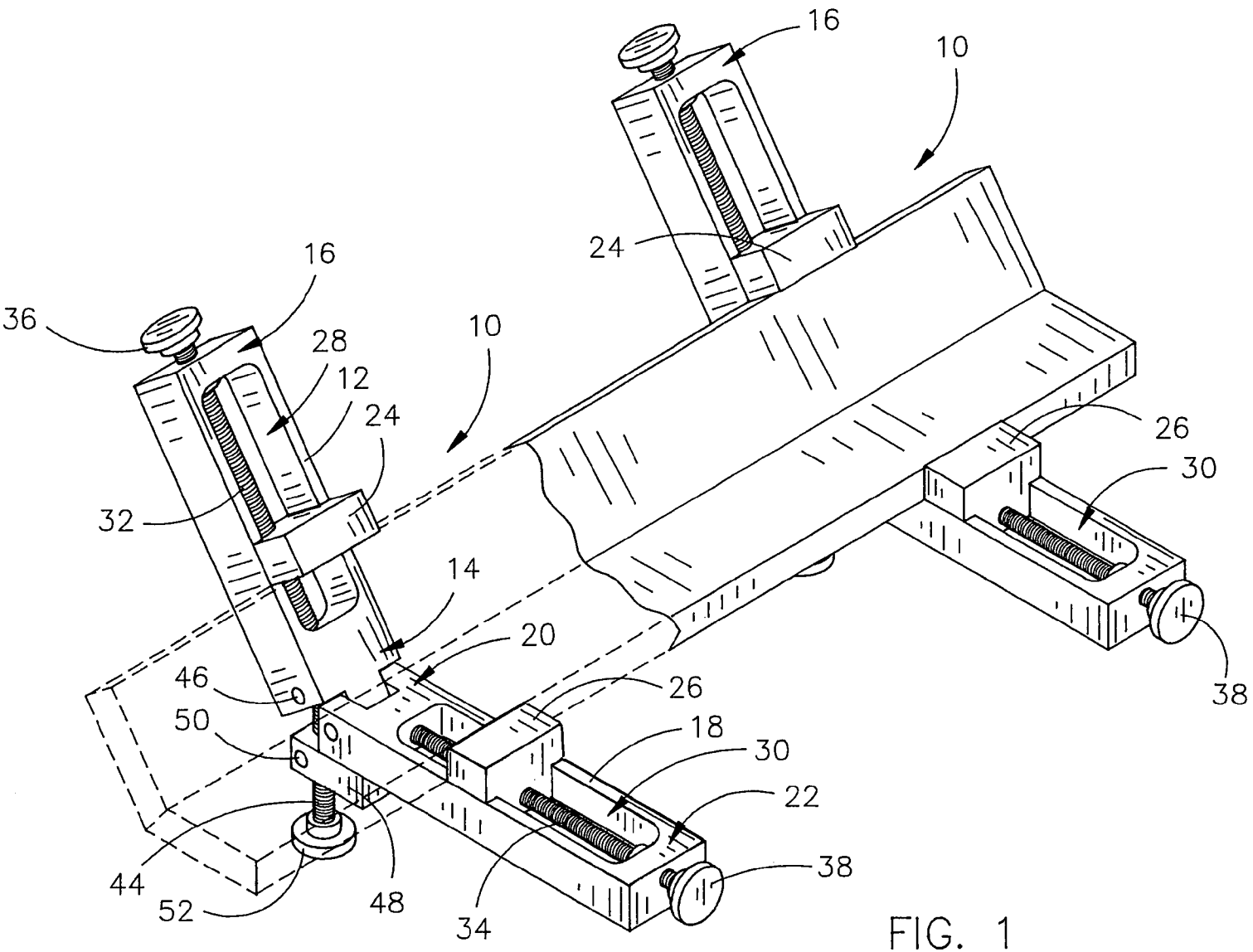
FIG. 1 is an isometric view of one embodiment of the adjustable angle clamp of the present invention as the same could be used with a second clamp of the present invention to secure opposing objects to one another along their lengths.
Figure 2:
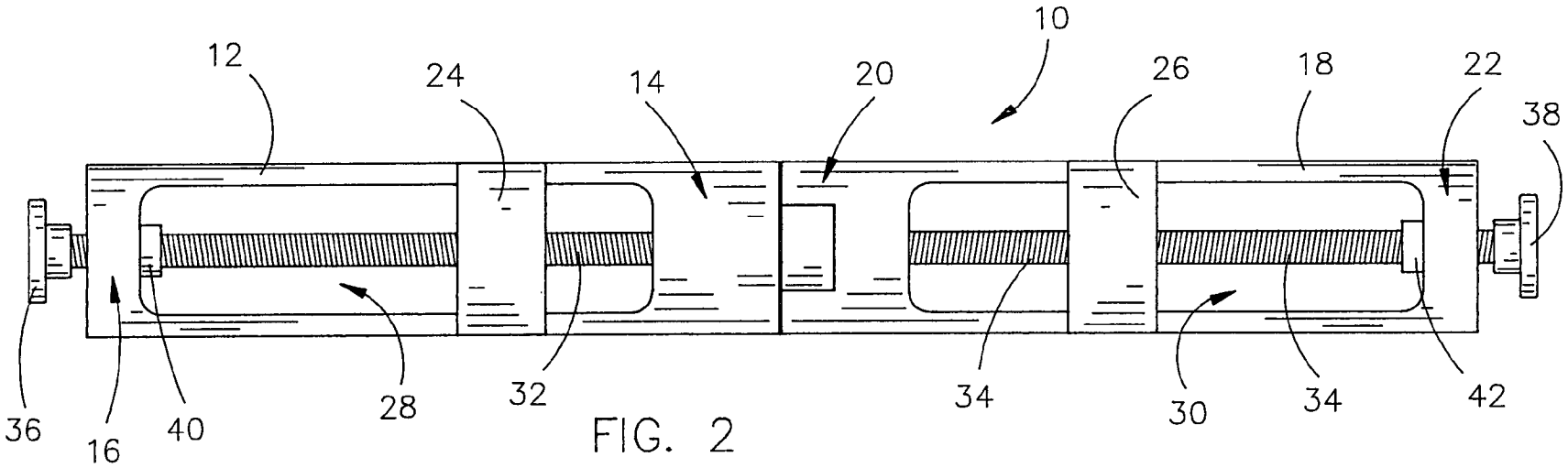
FIG. 2 is a top plan view of one of the adjustable angle clamps depicted in FIG. 1.

The clamping device 10 is provided with a first arm member 12, having a length that extends between a first end portion 14 and a second end portion 16. A second arm member is also provided, having a length that extends between a first end portion 20 and a second end portion 22. The first and second arm members 12 and 18 are pivotably coupled to one another at their first end portions 14 and 20 so that they may be selectively moved in variable angular relationships with one another. The clamping device 10 is depicted in FIG. 1 as having a forked hinge that pivots about a single pin extending through the forked first end portions 14 and 20. However, it is contemplated that a wide array of different structural arrangements could be employed to pivotably couple the first arm member 12 with the second arm member 18 without departing from the scope of the present invention. It is merely important that the pivoting section of the clamping device 10 be of sufficient strength and provide the desired range of motion for the clamping operations intended.

The clamping device 10 is provided with a first jaw member 24 that is operatively coupled with the first arm member 12 so that the first jaw member 24 may be selectively moved along the length of the first arm member 12. Similarly, the second arm member 18 is provided with a second jaw member 26 that may be selectively moved along the length of the second arm member 18. Channel members 28 and 30 are disposed along the lengths of the first arm member 12 and the second arm member 18, respectively. The channel members 28 and 30 are shaped and sized to receive at least a portion of the lower ends of the jaw members 24 and 26, as depicted in the accompanying figures. The coordinating shapes of the jaw members 24 and 26 to their respective channels 28 and 30 substantially prevent rotational movement of the jaw members 24 and 26, guiding them in linear paths along the lengths of the first arm member 12 and second arm member 18. However, while the first and second jaw members 24 and 26 are depicted as having uniformly planar, polygonal surfaces, it is contemplated that the jaws could be shaped in curved or angular orientations for use in particular clamping operations.

Elongated guide rods 32 and 34 are coupled with the first arm member 12 and second arm member 18, so that the guide rods 32 and 34 extend at least partially along the lengths of the first arm member 12 and second arm member 18. It is preferred that the guide rods 32 and 34 extend at least partially from the second end portions 16 and 22 of the arm members so that they may be manually engaged. Handles 36 and 38 may be disposed on the ends of the guide rods 32 and 34 that extend from the arm members to facilitate manual engagement of the same. Preferably, the opposite ends of the guide rods 32 and 34 are rotatably coupled with the first end portions 14 and 20 of the first and second arm members. However, it is contemplated that the opposite ends of the guide rods 32 and 34 could be disposed freely within the first arm member 12 and the second arm member 18. Retaining nuts 40 and 42 are coupled with the guide rods 32 and 34 to prevent their unintended removal from the arm members.

The first and second jaw members 24 and 26 should be shaped to engage the guide rods 32 and 34 so that they may be selectively moved along the lengths of the guide rods 32 and 34. In a preferred embodiment, the guide rods 32 and 34 are threaded and the first and second jaw members 24 and 26 are provided with mating threads so that the first and second jaw members 24 and 26 may be incrementally advanced or withdrawn along the lengths of the first arm member 12 and second arm member 18 as the guide rods 32 and 34 are rotated. In this manner, the first and second jaw members 24 and 26 are independently movable along their respective arm members to accommodate the placement of objects of different sizes between the opposing first and second jaw members 24 and 26. It is also contemplated that the lengths of the first arm member 12 and second arm member 18 (as well as coordinating structures) may be provided in various lengths to accommodate the dimensions of the objects that are to be clamped to one another. In an alternate embodiment, the opposite ends of the guide rods 32 and 34 are disposed freely within the first arm member 12 and the second arm member 18. The first and second jaw members 24 and 26 are be coupled with the guide rods 32 and 34, respectively, so that the jaw members and the guide rods remain in a fixed position with respect to one another as they are advanced or withdrawn along the lengths of the arm members. Quick adjust system, such as those provided on other clamps in the art, can be provided with both jaw members to allow a user to move the jaw members along the lengths of their respective guide rods prior to being set in position with respect to the guide rods.

While it is contemplated that objects could be clamped against one another in the clamping device 10 without a specific means to secure the first arm member 12 in a particular angular relationship with the second arm member 18, an angular adjustment mechanism will provide repeatable accuracy in the setting of specific angles as well as substantially prevent the unintended relational movement between the first arm member 12 and the second arm member 18. In a preferred embodiment, an angle adjustment screw 44 is coupled with the first arm member 12 and second arm member 18 to provide such accurate and secure angular settings. Preferably, a terminal end portion of the angle adjustment screw 44 is rotatably received by an adjustment swivel pin 46 that is rotatably disposed within the first end portion 14 of the first arm member 12. The adjustment swivel pin 46 permits the free rotation of the terminal end of the angle adjustment screw 44, while the swivel pin 46 freely pivots on an axis transverse with the first arm member 12. However, it is contemplated that the clamping device 10 could be assembled and used without a swivel pin 46, permitting the terminal end portion of the adjustment screw 44 to releasably engage the first end portion 14 of the first arm member 12, as the adjustment screw 44 is advanced.

Figure 3:
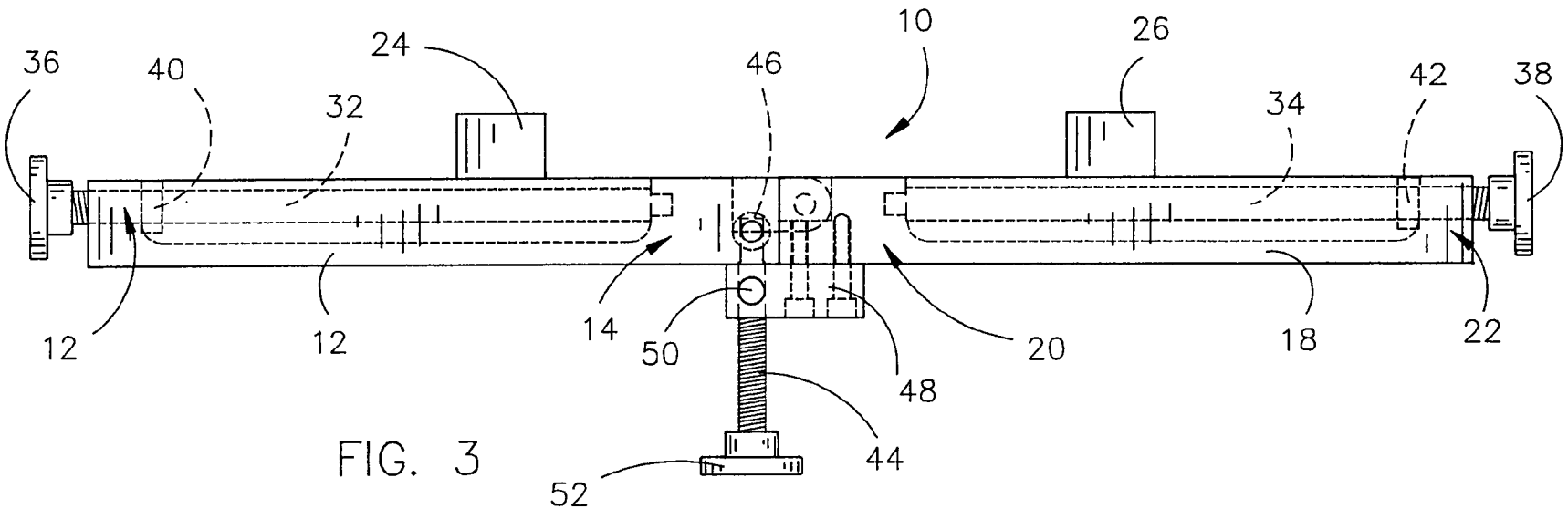
FIG. 3 is a side elevation view of one of the adjustable angle clamps depicted in FIG. 1.

An adjustment block 48 may be secured to the first end portion 20 of the second arm member 18 as depicted in FIG. 3. The adjustment block 48 is preferably shaped to allow the passage of the angle adjustment screw 44 therethrough as it is manually rotated. In one preferred embodiment, a second adjustment swivel pin 50 is disposed within the adjustment block 48 so that it may freely rotate about an axis that is transverse to the length of the second arm member 18. An opening is formed through the adjustment swivel pin 50 to engage the angle adjustment screw 44 to properly meter the incremental advancement or retraction of the angle adjustment screw 44 therethrough. In one particular embodiment, the angle adjustment screw 44 and the adjustment swivel pin 50 are threaded so that the incremental movement is provided through the rotation of the angle adjustment screw 44. A handle 52 may be provided on the free end of the angle adjustment screw 44 to assist in the manual actuation of the same.

Figure 4:
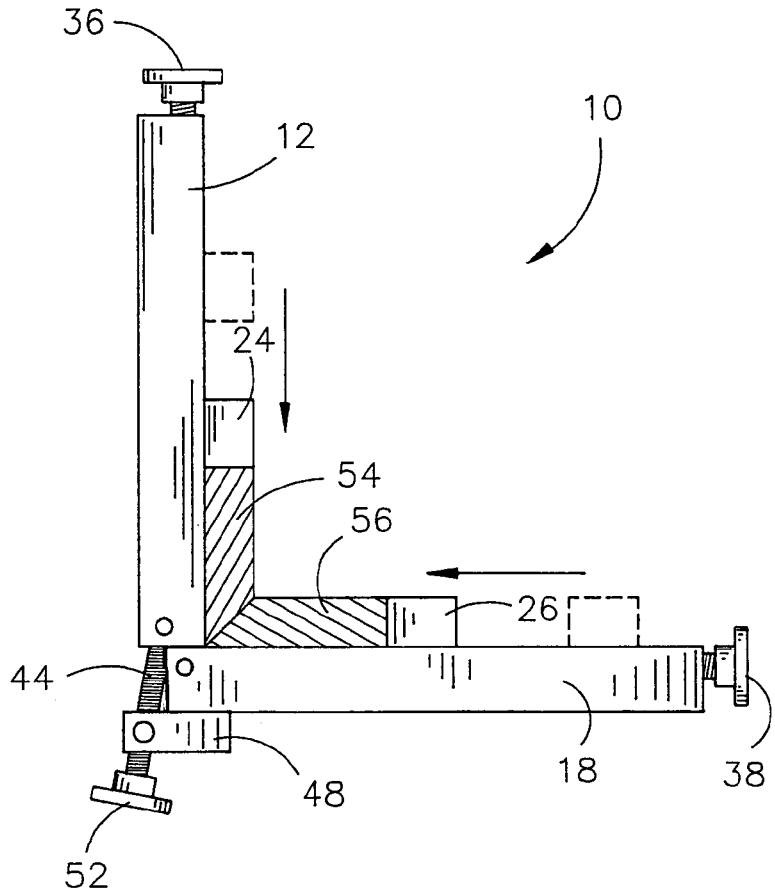
FIG. 4 is a side elevation view of one of the adjustable angle clamps of FIG. 1 as the same could be used to clamp a pair of opposing objects in a right angle with respect to one another.
Figure 5:
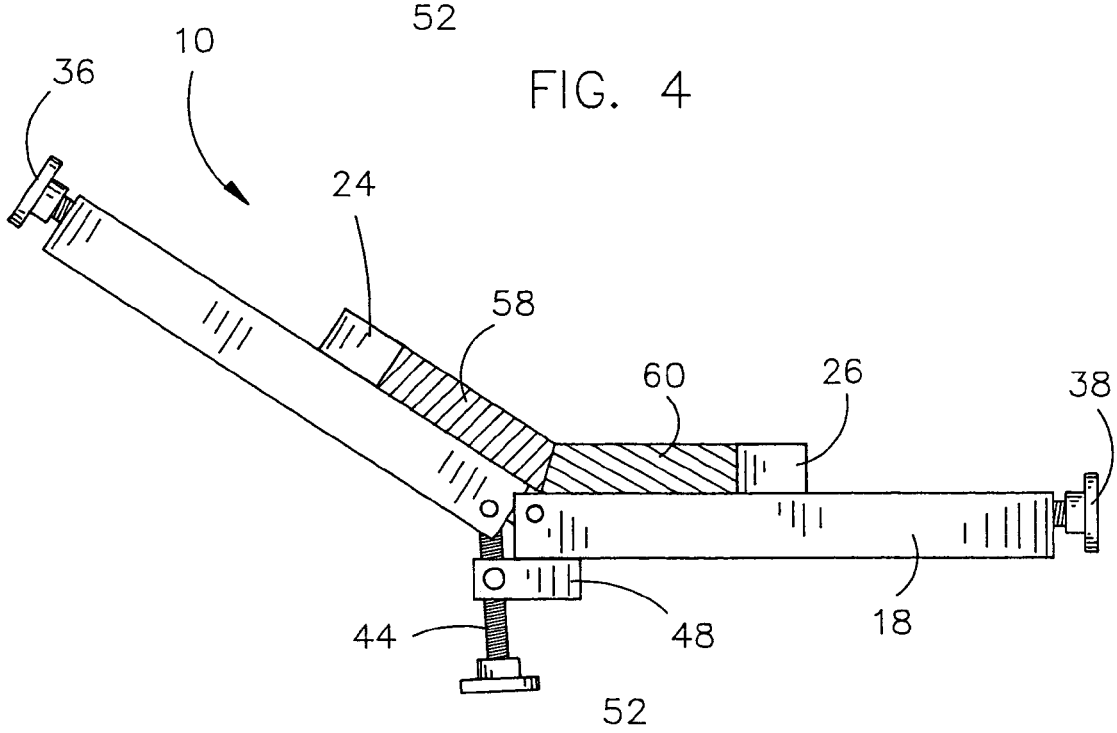
FIG. 5 is a side elevation view of the adjustable angle clamp of FIG. 4 as the same could be used to clamp a pair of opposing objects in an obtuse angle with respect to one another.

FIG. 4 depicts one intended use of the clamping device 10, where a pair of opposing pieces of wood 54 and 56 are clamped to one another in a right angle. The figure clearly depicts the direction of the forces applied by the first and second jaw members 24 and 26, where the pieces of wood 54 and 56 are simultaneously secured between the first and second jaw members 24 and 26 and the upper surfaces of the first arm member 12 and second arm member 18, which are accurately disposed at the selected angle. In this manner, substantially uniform pressure is applied along the joint that is formed between the pieces of wood 54 and 56. A similar uniform pressure is obtained in the joint formed between the pieces of wood 58 and 60, depicted in FIG. 5, which are disposed at an obtuse angle with respect to one another. The design of the clamping device 10 provides secure containment of the clamping forces along three sides of the wooden structure that results from the securement of wood pieces 58 and 60 to one another.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A device for clamping opposing structures to one another, the device comprising:

a first arm member having a length extending between opposite first and second end portions;

a second arm member having a length extending between opposite first and second end portions; said first end portion of said second arm member being pivotably coupled with the first end portion of said first arm member so that said first and second arm members may be selectively moved in a common plane throughout variable angular relationships with respect to one another;

a first jaw member operatively coupled to said first arm member so that said first jaw member is selectively positionable along the length of said first arm member;

a first means for selectively advancing and withdrawing said first jaw member along a path that is generally parallel with the length of said first arm member;

a second jaw member operatively coupled to said second arm member so that said second jaw member is selectively positionable along the length of said second arm member; and a second means for selectively advancing and withdrawing said second jaw member along the length of said second arm member.

2. The device of claim 1 further comprising means for advancing and retracting said first and second arm members through said variable angular relationships with one another and securing said first and second arm members in a selected angular relationship with one another.

3. The device of claim 2 wherein said means for advancing and retracting said first and second arm members is comprised of a manually actuated angle adjustment screw that is operatively coupled with said first and second arm members.

4. The device of claim 3 wherein said means for advancing and retracting said arm members is further comprised of an adjustment block operatively coupled to the first end portion of said first arm member; said adjustment block being shaped to operatively receive said angle adjustment screw.

5. The device of claim 4 wherein said means for advancing and retracting said first and second members is further comprised of a swivel pin operatively rotatably coupled to the first end portion of said second arm member; said swivel pin being shaped to receive a terminal end portion of said adjustment screw.

6. The device of claim 5 further wherein said means for advancing and retracting said first and second arm members is comprised of an adjustment swivel that is rotatably coupled with said adjustment block and shaped to incrementally receive said adjustment screw.

7. The device of claim 1 wherein said first and second means for advancing and retracting said first and second jaw members are each comprised of elongated rods, having lengths extending between first and second end portions, which extend at least partially along the lengths of said arm members.

8. The device of claim 7 wherein at least the first end portions of said rods extend outwardly from the second end portions of said arm members.

9. The device of claim 8 wherein said first and second jaw members are each shaped to incrementally receive one of said rods so that said jaws may be selectively advanced and retracted along the lengths of said rods.

10. The device of claim 8 wherein said rods are threaded and said first and second jaw members are selectively advanced or retracted along the lengths of said rods in response to rotation of said rods.

11. A device for clamping opposing structures to one another, the device comprising:

a first arm member having a length extending between opposite first and second end portions and a jaw member that is operatively coupled to said first arm member so that said jaw member may be selectively positioned in one of a plurality of different positions along a path that is generally parallel with the length of said first arm member; and a second arm member having a length extending between opposite first and second end portions and a jaw member that is operatively coupled to said second arm member so that said jaw member may be selectively positioned in one of a plurality of different positions along the length of said second arm member;

said first end portion of said first arm member being pivotably coupled with the first end portion of said second arm member so that said first and second arm members may be selectively moved in a common plane throughout variable angular relationships with respect to one another.

12. The device of claim 11 further comprising an angle adjustment rod operatively coupled with the first end portions of said first and second arm members so that said first and second arm members may be selectively moved in variable angular relationships with respect to one another by the rotation of said angle adjustment rod.

13. The device of claim 11 further comprising an elongated rod extending along at least a portion of the length of said first arm member; said rod being operatively coupled to the jaw member of said first arm member so that said jaw member may be selectively advanced or withdrawn along the length of said first arm member by the rotation of said rod.

14. The device of claim 13 further comprising an elongated rod extending along at least a portion of the length of said second arm member; said rod being operatively coupled to the jaw member of said second arm member so that said jaw member may be selectively advanced or withdrawn along the length of said first arm member by the rotation of said rod.

15. The device of claim 14 further comprising an angle adjustment rod operatively coupled with the first end portions of said first and second arm members so that said first and second arm members may be selectively moved in variable angular relationships with respect to one another by the rotation of said angle adjustment rod.

16. The device of claim 15 further comprising a swivel pin operatively rotatably coupled to the first end portion of said second arm member; said swivel pin being shaped to receive a terminal end portion of said adjustment screw.

17. The device of claim 16 further comprising an adjustment block operatively coupled to the first end portion of said first arm member; said adjustment block being shaped to operatively receive said angle adjustment screw.

18. The device of claim 17 further comprising an adjustment swivel that is rotatably coupled with said adjustment block and shaped to incrementally receive said adjustment screw.

* * * * *